US010072216B2

(12) United States Patent
Venkatesh

(10) Patent No.: US 10,072,216 B2
(45) Date of Patent: Sep. 11, 2018

(54) MULTIPLE PREFLASH AND EXCHANGER (MPEX) NETWORK SYSTEM FOR CRUDE AND VACUUM UNITS

(71) Applicant: Fluor Technologies Corporation, Sugar Land, TX (US)

(72) Inventor: Chilkunda K. Venkatesh, Irvine, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

(21) Appl. No.: 15/604,878

(22) Filed: May 25, 2017

(65) Prior Publication Data

US 2017/0260459 A1 Sep. 14, 2017

Related U.S. Application Data

(62) Division of application No. 14/312,138, filed on Jun. 23, 2014, now Pat. No. 9,677,006.

(60) Provisional application No. 61/838,838, filed on Jun. 24, 2013.

(51) Int. Cl.
*C10G 7/00* (2006.01)

(52) U.S. Cl.
CPC ..... *C10G 7/00* (2013.01); *C10G 2300/308* (2013.01); *C10G 2300/4056* (2013.01); *Y10T 29/49716* (2015.01)

(58) Field of Classification Search
CPC ..... C10G 7/00; C10G 2300/308; C10G 2300/4056; Y10T 29/49716
See application file for complete search history.

(56) References Cited

U.S. PATENT DOCUMENTS

| | | | |
|---|---|---|---|
| 4,082,653 | A | 4/1978 | DeGraff |
| 4,239,618 | A | 12/1980 | Peiser et al. |
| 4,664,784 | A | 5/1987 | Harandi |
| 4,664,785 | A | 5/1987 | Devos et al. |
| 4,919,794 | A | 4/1990 | Lipkin et al. |
| 5,192,421 | A | 3/1993 | Audeh et al. |
| 5,456,823 | A | 10/1995 | Lermite et al. |
| 7,172,686 | B1 | 2/2007 | Ji et al. |
| 2011/0168523 | A1 | 7/2011 | Sawai |

FOREIGN PATENT DOCUMENTS

| | | | |
|---|---|---|---|
| EP | 0213791 | A2 | 3/1987 |
| EP | 2354212 | A1 | 8/2011 |
| RU | 2181749 | C1 | 4/2002 |

(Continued)

OTHER PUBLICATIONS

Barletta, T. et al. (2004). Foam Control in Crude Units, PTQ, 117-125.*

(Continued)

*Primary Examiner* — Brian A Mccaig
(74) *Attorney, Agent, or Firm* — Conley Rose, P.C.

(57) ABSTRACT

Plants and methods are presented for crude feed pre-processing before feeding the crude feed into a crude unit or vacuum unit. Pre-processing is preferably achieved with a combination of a preflash drum and a preflash column that allows for high-temperature treatment of the liquids and separate vapor phase handling, which advantageously enables retrofitting existing plants to accommodate lighter crude feeds.

20 Claims, 2 Drawing Sheets

(56) References Cited

FOREIGN PATENT DOCUMENTS

| | | | |
|---|---|---|---|
| WO | 2013098270 | A1 | 7/2013 |
| WO | 2013107738 | A1 | 7/2013 |

OTHER PUBLICATIONS

Golden, Scott, "Crude Unit Preflash Drums and Columns," Process Consulting Services, Inc., Texas, USA, 2005.
Errico, Massimiliano et al, "Energy Saving in a Crude Distillation Unit by a Preflash Implementation," Applied Thermal Engineering 29, pp. 1642-1647, 2009.
U.S. Appl. No. 14/312,138, Restriction Requirement, dated May 16, 2016, 7 pages.
U.S. Appl. No. 14/312,138, Office Action, dated Aug. 22, 2016, 9 pages.
U.S. Appl. No. 14/312,138, Notice of Allowance, dated Feb. 2, 2017, 9 pages.

* cited by examiner

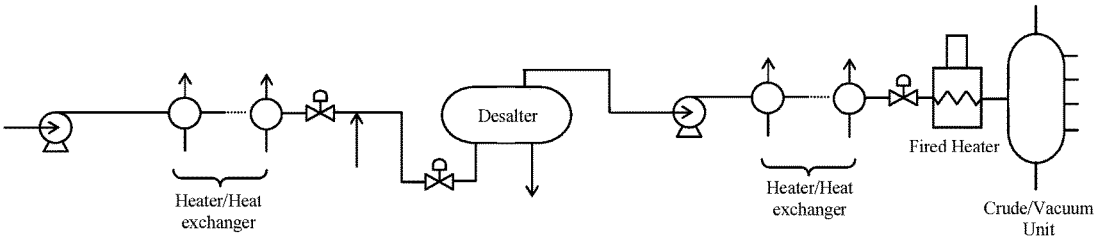
Prior Art Figure 1
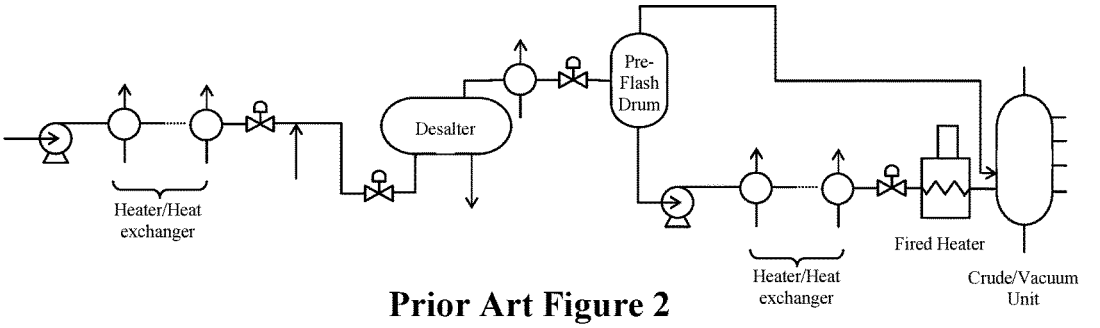
Prior Art Figure 2
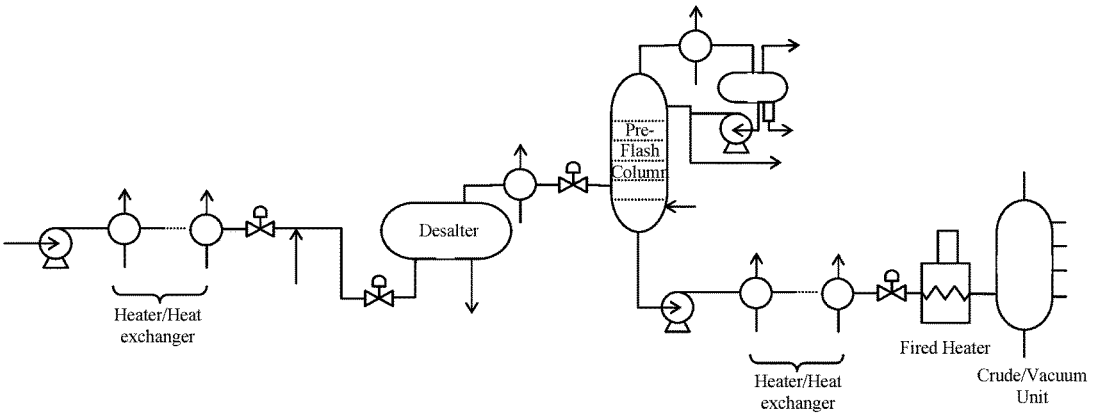
Prior Art Figure 3

MULTIPLE PREFLASH AND EXCHANGER (MPEX) NETWORK SYSTEM FOR CRUDE AND VACUUM UNITS

CROSS-REFERENCE TO RELATED APPLICATIONS

This application is a divisional of U.S. patent application Ser. No. 14/312,138 filed on Jun 24, 2014 which claims priority to U.S. Provisional Patent Application Ser. No. 61/838,838, filed Jun. 24, 2013, both of which are incorporated by reference herein in their entireties.

FIELD OF THE INVENTION

The field of the invention is processing of crude oil, and especially pre-processing of lighter crude oil prior to entry into a crude or vacuum unit.

BACKGROUND OF THE INVENTION

The background description includes information that may be useful in understanding the present invention. It is not an admission that any of the information provided herein is prior art or relevant to the presently claimed invention, or that any publication specifically or implicitly referenced is prior art.

In the last 30-40 years, the trend in the refining industry has been to design and optimize Crude and Vacuum Units to process heavy crudes. However, with the development and adoption of fracking technology, lighter crudes are becoming increasingly available. As a result, existing units as exemplarily illustrated in Prior Art FIG. 1 often must be retrofitted to process lighter crudes (e.g., Bakken crudes) since lighter crudes typically require higher operating pressures to maintain the lighter components in the liquid phase. Alternatively, or additionally, vaporization of the lighter components will increase the throughput volume, which in most cases leads to increased backpressure that can be damaging to the unit and may decrease overall throughput and quality of the processed crude.

To overcome at least some of the difficulties associated with lighter components in a crude feed, a pre-processing train may be retrofitted to include a preflash drum as exemplarily shown in Prior Art FIG. 2. However, the vapor phase form the preflash drum is typically fed to the crude or vacuum unit and as such adds throughput volume on the crude or vacuum unit. Moreover, the preflash drum does generally not provide for a separation of the vapor and liquid phase that would produce the vapor phase as a value product. Better separation efficiency can be obtained using a preflash column as is exemplarily shown in Prior Art FIG. 3. Here, the crude feed is subjected to a steam stripping/separation column that produces a liquid naphtha fraction that can be used as a value product or feed to another processing plant, and the liquid phase is fed to the crude or vacuum unit. While such systems advantageously allow for withdrawal of some of the vapor phase, pressure increase in the preflash column may still be an issue.

Still other configurations and methods as, for example, described in U.S. Pat. No. 4,082,653 teach a system with multiple flash zones where the vapors and the liquids are all fed into a downstream crude column. While such system provides certain advantages, the multi-flash arrangement of the '653 patent will generally not resolve the issue of excess vapor production. Similarly, US 2011/0168523 describes a system with two flash zones for two distinct feeds for a crude unit and a vacuum unit. Once more, such system is generally inappropriate both as a retrofit and as a stand-alone system to accommodate preprocessing of light crude. All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, even though various systems and methods for pre-processing crude are known in the art, all or almost all of them suffer from one or more disadvantages. Therefore, there is still a need to provide improved systems and methods of pre-processing of lighter crude oil prior to entry into a crude or vacuum unit.

SUMMARY OF THE INVENTION

The inventor has now discovered that pre-processing of lighter crude oil prior to entry into a crude or vacuum unit can be substantially improved by including both a preflash drum and a preflash column. Among other advantages, it should be noted that the systems and methods contemplated herein will greatly reduce or even eliminate the need for high operating pressures. Moreover, the retrofitting can be done in most cases with minimal existing equipment changes and will so provide a much more economically attractive solution.

In one aspect of the inventive subject matter, a method of pre-processing a crude feed prior to feeding into a crude unit or vacuum unit. Especially contemplated methods will include a step of heating the crude feed to form a heated crude feed, and feeding the heated crude feed to a preflash drum to form a vapor stream and a liquid stream. In another step, the liquid stream is heated to form a heated liquid stream, and the heated liquid stream is then fed into a preflash column, where the heated liquid stream is reboiled or is subject to steam stripping to thereby form a pre-processed feed. Most typically, the vapor stream is fed the preflash column, the preflash condenser, and/or the preflash column overhead, while the pre-processed feed is fed to the crude unit or vacuum unit.

While not limiting to the inventive subject matter, it is generally preferred that the crude feed API gravity is 27° API or higher. It is further contemplated that the heated crude feed has a first temperature, the heated liquid stream has a second temperature, and that the first temperature is lower than the second temperature.

In other preferred aspects, the preflash drum and the preflash column operate at about the same pressure, and/or the heated liquid stream is subject to steam stripping in the preflash column. Most typically the vapor stream is fed to the preflash column at a level at or above a level at which the heated liquid stream is fed to the preflash column. Furthermore, it is contemplated that the preflash column overhead is partially condensed to form an overhead vapor fraction and/or a hydrocarbon liquid, and at least a portion of the hydrocarbon liquid (where desired) is used as a reflux stream to the preflash column. Where appropriate, the preflash column and the preflash drum can be stacked in a single tower, and may be separated from each other via a chimney tray.

Therefore, the inventors also contemplate a method of retrofitting a processing line for processing a crude feed prior to routing the crude feed to a crude unit or vacuum unit.

In such contemplated methods, the processing line typically includes a preflash drum (PFD) or a preflash column (PFC). In one step, a retrofit preflash column (RPFC) or a retrofit preflash drum (RPFD) is coupled to the preflash drum (PFD) or preflash column (PFC), respectively, to so form a processing train that comprises a PFD-RPFC or RPFD-PFC sequence, wherein the preflash drum or retrofit preflash drum receives a heated crude feed and to produce a vapor stream and a liquid stream. In another step, a heater is coupled between the PFD or RPFD and the RPFC or PFC such that the heater heats the liquid stream to form a heated liquid stream, wherein the preflash column or retrofit preflash column receives the heated liquid stream and optionally and separately the vapor stream. Most typically, the preflash column or retrofit preflash column uses a reboiler or steam stripping unit to so form a pre-processed liquid feed, and the preflash column or retrofit preflash column are coupled to the crude unit or the vacuum unit such that the crude unit or the vacuum unit receives the pre-processed liquid feed.

In further contemplated aspects, the heated crude feed has a first temperature, the heated liquid stream has a second temperature, wherein the first temperature is typically lower than the second temperature. It is further contemplated that the PFD and the RPFC or the RPFD and the PFC operate at about the same pressure, and/or that the preflash column or the retrofit preflash column use a steam stripping unit to form the pre-processed liquid feed. Additionally, it is contemplated that the preflash column or the retrofit preflash column produce a preflash column overhead or retrofit preflash column overhead, respectively, and that the preflash column overhead or retrofit preflash column overhead is fed to a destination other than the a crude unit or vacuum unit. While not limiting to the inventive subject matter, it is contemplated that the PFD-RPFC or RPFD-PFC sequence is stacked in a single tower, optionally separated from each other via a chimney tray.

Viewed from a different perspective, the inventors also contemplate a pre-processing plant for pre-processing a crude feed. Especially preferred pre-processing plants comprise a preflash drum that is fluidly coupled to a preflash column and forms from a heated crude feed a vapor stream and a liquid stream. A heater is also included to receive and heat the liquid stream to so form a heated liquid stream, wherein the preflash column uses a reboiler or steam unit as a heat source, and wherein the preflash column receives the heated liquid stream to form a pre-processed feed using the reboiler or steam unit. Additionally, it is contemplated that the pre-processing plant will include a preflash condenser that is coupled to the preflash column and that receives the vapor stream and/or a preflash column overhead, and a conduit is included to convey the vapor stream to the preflash column, the preflash column overhead, and/or the preflash condenser.

Most preferably, the pre-processing plant will be coupled to a crude unit or vacuum unit (e.g., fluidly coupled to the preflash column to receive the pre-processed feed), and the preflash drum and the preflash column will operate at about the same pressure while the preflash column preferably uses a steam unit. Similar as discussed above, the preflash column may also comprises a preflash overhead condenser that produces an overhead vapor fraction and a hydrocarbon liquid, and optionally includes a conduit that feeds at least some of the hydrocarbon liquid as a reflux stream to the preflash column.

Various objects, features, aspects and advantages of the present invention will become more apparent from the following detailed description of preferred embodiments of the invention.

BRIEF DESCRIPTION OF THE DRAWING

Prior Art FIG. 1 is an exemplary schematic of a known processing line for crude oil without preflash drum or preflash column.

Prior Art FIG. 2 is an exemplary schematic of a known processing line for crude oil with a preflash drum.

Prior Art FIG. 3 is an exemplary schematic of a known processing line for crude oil with a preflash column.

DETAILED DESCRIPTION

Figure 4:
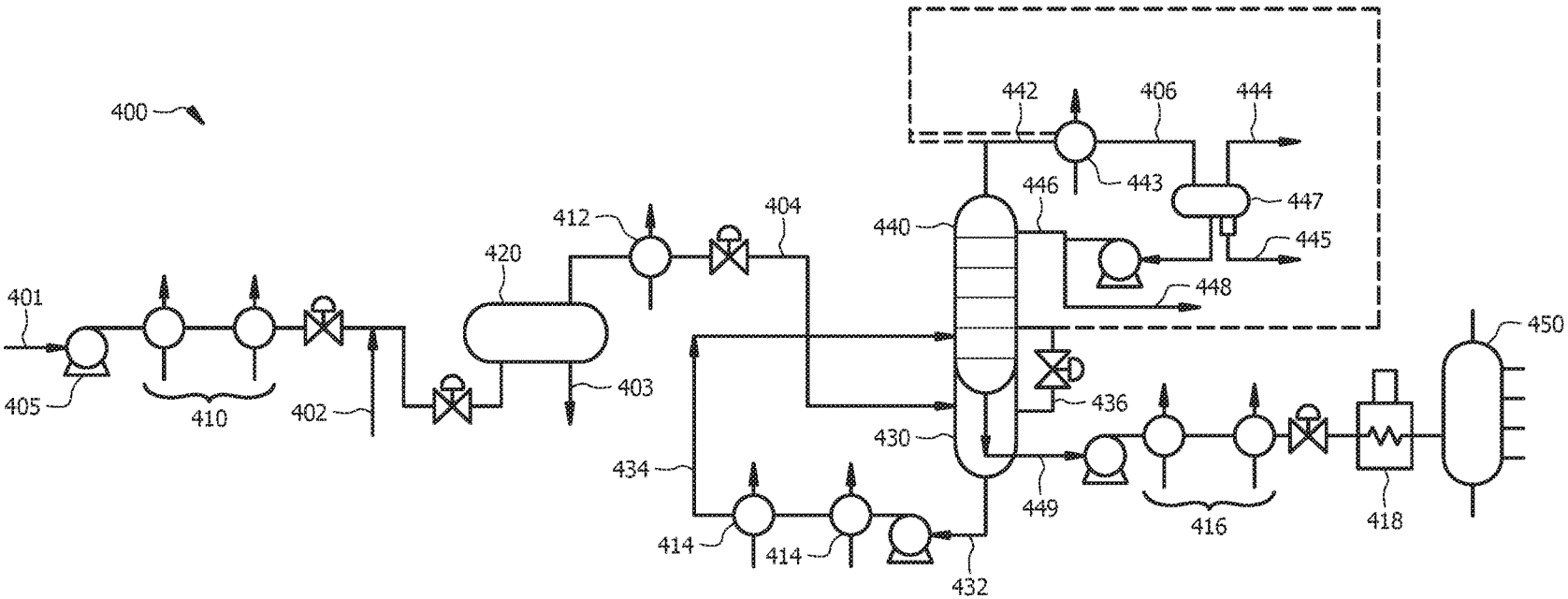
FIG. 4 is an exemplary schematic of a pre-processing line for crude oil with a preflash drum and preflash column according to the inventive subject matter.

The inventors have now discovered that problems associated with handling lighter feed in units originally designed for a heavier feed (e.g., increased backpressure or processing volume) can be effectively addressed by combined use of a preflash drum and preflash column where the vapors are removed from the system (preferably after further processing in the preflash column) and where the liquids are heated above temperatures ordinarily encountered for preflash drums and preflash columns.

In one exemplary aspect of the inventive subject matter as schematically illustrated in FIG. 4, a pre-processing plant 400 for pre-processing a crude feed 401 is pumped by pump 405 and heated in exchangers 410 prior to combination with wash water 402 as is commonly practiced. After passing through desalter 420 and removal of desalter effluent 403, the washed crude is then heated by heater 412, typically to a temperature of between about 120° C. and about 180° C. before feeding the heated crude feed 404 into preflash drum 430. The liquid stream 432 is then passed through one or more further heaters 414, typically to a temperature of between about 150° C. and about 240° C. to so form heated liquid stream 434 that is now fed into the preflash column 440. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. While FIG. 4 illustrates the preflash drum and the preflash column in a configuration in which the preflash drum and the preflash column are integrated into a single column, it should be appreciated that the preflash drum and preflash column may also be physically separate, particularly where a retrofit configuration is being built. Where the preflash column and the preflash drum are stacked in a single tower, it is contemplated that the drum and column may be separated from each other via a chimney tray (and thus operate at the same pressure).

The vapor stream 436 is fed from the preflash drum 430 to the preflash column 440 (and where desired also to the preflash column overhead 442 and/or preflash condenser 443, most typically at or above a location where the heated liquid stream is fed to the preflash column. It should be recognized that by including a preflash drum in addition to the preflash column naphtha separation can be optimized in the preflash column by proper selection of the preheat temperature without being constrained by vaporization limits of the crude feed at a given operating pressure. Viewed from a different perspective, it should be appreciated that the preflash column bottom stream has a significant proportion of the lighter boiling materials removed and can therefore be preheated by heat exchange with other hot streams in the unit to a higher temperature without running the risk of partial vaporization in the heat exchanger network. While not particularly preferred, it is contemplated that in some aspects the preflash column could be replaced by a second preflash drum. Still further, it should be noted that due to the drop in pressure in the preflash drum, water and lighter components are vaporized and leave the preflash drum to enter the preflash column as a vapor stream. Finally, it is noted that while the preflash drum can be operated at a higher pressure than the preflash column, it is generally preferred that the preflash drum be operated at about the same pressure as the preflash column. As used in conjunction with a numeral herein, the term "about" refers to a +/−10% range of that numeral, inclusive. For example, the preflash drum can be operated at a pressure of about 212 kPa to 650 kPa while the preflash column can be operated at a pressure of about 205 kPa to 620 kPa. Thus, suitable pressure differences between the preflash drum and the preflash column will typically be between 7 and 30 kPa. Thus, the preflash drum pressure is typically higher than the preflash column pressure.

Heating of the liquid stream 432 is typically performed by heat exchange with available hot streams in the crude pre-processing unit or by supplementary heat sources to the temperature desired before entering the preflash column where the lighter components rise up the tower and the residue is steam stripped. It should be noted that where the crude feed is extremely light, a reboiler could be used in place of a steam unit.

The preflash column 440 preferably has a plurality of trays and is coupled to a preflash column condenser unit comprising overhead condenser 443 and overhead separator drum 447 that receives the partially condensed preflash column overhead 406. Sour water 445 and gas 444 are withdrawn from the overhead separator drum 447, while liquid naphtha product 446 is used as reflux 446 and/or value product stream 448 (which may be further processed or stabilized). The preflash column 440 further produces a pre-processed feed 449 that is passed though heaters 416 (e.g., heat exchangers) and fired heater 418 before feeding the heated pre-processed feed into crude or vacuum unit 450.

With respect to the crude feed it is noted that systems and methods contemplated herein will be capable of processing a wide variety of crude feeds ranging from heavy feeds to light and very light crude feeds. For example, crude feeds that are especially suitable for the plants according to FIG. 4 include those that have an API gravity greater than 27° API. Therefore, conventional plants according to Prior Art FIGS. 1-3 will particularly benefit of an upgrade to a configuration of FIG. 4 where the crude feed has an API gravity greater than 27° API. Therefore, it should be especially noted that plants and systems according to FIG. 4 may also be equipped with conduits and switching valves (not shown) that allow bypassing of the preflash drum and/or preflash column in the event that the crude feed is switched back to a heavier feed.

Most preferably, heaters and heat exchangers will be configured and implemented in the plant such that existing heat content is recycled within the plant, or obtained from a source outside the preprocessing unit (e.g., from a downstream boiler, turbine exhaust, or other waste heat source), or a dedicated heater or heat exchanger. It should also be appreciated that the temperature of the various crude, liquid, and vapor streams are selected such that the vapor pressure in the downstream devices is sufficient to achieve a desired separation. Therefore, suitable temperatures for the heated crude feed is between about 120° C. and about 180° C., for the heated liquid stream between about 150° C. and about 240° C., for the partially condensed preflash column overhead between about 135° C. and about 25° C., and for the pre-processed feed between about 145° C. and about 235° C. Most preferably, and in a different aspect of the inventive subject matter, the temperature difference between the heated crude feed entering the preflash drum and the heated liquid stream entering the preflash column is between about 30° C. and about 100° C. Thus, the heated crude feed temperature is typically lower than the temperature of the heated liquid stream.

Therefore, it should be recognized that contemplated systems and methods allow for a higher temperature and sequential heating with at least one intermittent flash step to so form a heavier liquid product that can then be fed into the crude or vacuum unit without attendant undesired vapor generation. At the same time, as the vapors from the preflash drum and preflash column are not fed into the crude or vacuum unit, the crude or vacuum unit need not handle these vapors and existing units can be utilized (or new units can be scaled to a smaller configuration). Moreover, as at least part (and in some cases all) of the vapor is processed in the preflash column, a higher-grade naphtha (e.g., unstabilized naphtha) can be obtained that can be used as a value product or be further processed. Viewed from another perspective, the preflash column overhead (or retrofit preflash column overhead) can be fed to a destination other than a crude unit or vacuum unit.

Therefore, the inventors also contemplate a method of pre-processing a crude feed prior to feeding into a crude unit or vacuum unit. In especially preferred methods, the crude feed is first heated to form a heated crude feed, and then fed to a preflash drum to form a vapor stream and a liquid stream as already discussed above. In a further step, the liquid stream is additionally heated also addressed above to form a heated liquid stream, which is the fed into a preflash column. Depending on the chemical composition of the crude feed, it is noted that the preflash column can be operated using a reboiler or a steam unit for steam stripping to thereby form a pre-processed feed. The vapor stream from the preflash drum is then fed to the preflash column, the preflash column condenser unit, and/or the preflash column overhead, while pre-processed feed is fed to the crude unit or vacuum unit. With respect to the components, operating conditions, temperature and pressure ranges, and materials, the same considerations and aspects as discussed above for the plant configuration apply and are not reiterated here.

Of course, it should be appreciated that where a pre-processing plant is a retrofit plant, the inventors also contemplate a method of retrofitting a processing line. In most, but not all cases, the processing line has a preflash drum (PFD) or a preflash column (PFC), and the retrofitting activities include a step of coupling a retrofit preflash column (RPFC) or a retrofit preflash drum (RPFD) to the preflash drum (PFD) or preflash column (PFC), respectively, to so form a processing train that comprises a PFD-RPFC or RPFD-PFC sequence. As noted above, it is generally preferred that piping is added to the preflash drum or retrofit preflash drum to allow receiving a heated crude feed and to produce a vapor stream and a liquid stream. In another retrofit step, a heater is coupled between the PFD or RPFD and the RPFC or PFC such that the heater heats the liquid stream to form a heated liquid stream, and piping is added such that the preflash column or retrofit preflash column will receive the heated liquid stream and optionally and separately the vapor stream, and such that the preflash column or retrofit preflash column can use a reboiler or steam stripping unit to so form a pre-processed liquid feed. In yet another step, piping is added to fluidly couple the preflash column or retrofit preflash column to the crude unit or the vacuum unit such that the crude unit or the vacuum unit receives the pre-processed liquid feed. As before, and with respect to the components, operating conditions, temperature and pressure ranges, and materials, the same considerations and aspects as discussed above for the plant configuration apply and are not reiterated here.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of retrofitting a processing line for processing a crude feed prior to routing a crude feed to a crude unit or vacuum unit, wherein the processing line has a preflash drum (PFD) or a preflash column (PFC), comprising:

coupling a retrofit preflash column (RPFC) or a retrofit preflash drum (RPFD) to the preflash drum (PFD) or preflash column (PFC), respectively, to so form a processing train that comprises a PFD-RPFC or RPFD-PFC sequence;

wherein the preflash drum or retrofit preflash drum is configured to receive the crude feed and to produce a vapor stream and a liquid stream;

coupling a heater between the PFD or RPFD and the RPFC or PFC such that the heater heats the liquid stream to form a heated liquid stream;

wherein the preflash column or retrofit preflash column is configured to receive the heated liquid stream and optionally and separately the vapor stream, wherein the preflash column or retrofit preflash column is further configured to use a reboiler or steam stripping unit to so form a pre-processed liquid feed; and fluidly coupling the preflash column or retrofit preflash column to the crude unit or the vacuum unit such that the crude unit or the vacuum unit receives the pre-processed liquid feed.

2. The method of claim 1, wherein the crude feed has a first temperature, wherein the heated liquid stream has a second temperature, and wherein the first temperature is lower than the second temperature.

3. The method of claim 1, wherein the PFD and the RPFC or wherein the RPFD and the PFC operate at about the same pressure.

4. The method of claim 1, wherein the preflash column or the retrofit preflash column uses the steam stripping unit to form the pre-processed liquid feed.

5. The method of claim 1, wherein the preflash column or the retrofit preflash column produces a preflash column overhead or retrofit preflash column overhead, respectively, wherein the preflash column overhead or retrofit preflash column overhead is fed to a destination other than the the crude unit or vacuum unit.

6. The method of claim 1, wherein the PFD-RPFC or RPFD-PFC sequence are stacked in a single tower, and are optionally separated from each other via a chimney tray.

7. The method of claim 1, wherein:

1) coupling a retrofit preflash column (RPFC) or a retrofit preflash drum (RPFD) to the preflash drum (PFD) or preflash column (PFC), respectively, to so form a processing train that comprises a PFD-RPFC or RPFD-PFC sequence comprises:

coupling the retrofit preflash column (RPFC) to the preflash drum (PFD) to so form the processing train that comprises the PFD-RPFC sequence;

2) the preflash drum is configured to receive the crude feed and to produce the vapor stream and the liquid stream;

3) coupling a heater between the PFD or RPFD and the RPFC or PFC such that the heater heats the liquid stream to form a heated liquid stream comprises:

coupling the heater between the PFD and the RPFC such that the heater heats the liquid stream to form the heated liquid stream;

4) the retrofit preflash column is configured to receive the heated liquid stream and optionally and separately the vapor stream, wherein the retrofit preflash column is further configured to use the reboiler or steam stripping unit to so form the pre-processed liquid feed; and 5) fluidly coupling the preflash column or retrofit preflash column to the crude unit or the vacuum unit such that the crude unit or the vacuum unit receives the pre-processed liquid feed comprises:

fluidly coupling the retrofit preflash column to the crude unit or the vacuum unit such that the crude unit or the vacuum unit receives the pre-processed liquid feed.

8. The method of claim 7, wherein the retrofit preflash column is further configured to use the reboiler to so form the pre-processed liquid feed.

9. The method of claim 7, wherein the retrofit preflash column is further configured to use the steam stripping unit to so form the pre-processed liquid feed.

10. The method of claim 7, wherein the retrofit preflash column is configured to receive the heated liquid stream and the vapor stream.

11. The method of claim 10, wherein the heated liquid stream and the vapor stream are received by the retrofit preflash column separately.

12. The method of claim 7, wherein fluidly coupling the retrofit preflash column to the crude unit or the vacuum unit such that the crude unit or the vacuum unit receives the pre-processed liquid feed comprises:

fluidly coupling the retrofit preflash column to the crude unit such that the crude unit receives the pre-processed liquid feed.

13. The method of claim 7, wherein fluidly coupling the retrofit preflash column to the crude unit or the vacuum unit such that the crude unit or the vacuum unit receives the pre-processed liquid feed comprises:

fluidly coupling the retrofit preflash column to the vacuum unit such that the vacuum unit receives the pre-processed liquid feed.

14. The method of claim 1, wherein:

1) coupling a retrofit preflash column (RPFC) or a retrofit preflash drum (RPFD) to the preflash drum (PFD) or preflash column (PFC), respectively, to so form a processing train that comprises a PFD-RPFC or RPFD-PFC sequence comprises:

coupling the retrofit preflash drum (RPFD) to the preflash column (PFC) to so form the processing train that comprises the RPFD-PFC sequence;

2) the retrofit preflash drum is configured to receive the crude feed and to produce the vapor stream and the liquid stream;

3) coupling a heater between the PFD or RPFD and the RPFC or PFC such that the heater heats the liquid stream to form a heated liquid stream comprises:

coupling the heater between the RPFD and the PFC such that the heater heats the liquid stream to form the heated liquid stream;

4) the preflash column is configured to receive the heated liquid stream and optionally and separately the vapor stream, wherein the preflash column is further configured to use the reboiler or steam stripping unit to so form the pre-processed liquid feed; and 5) fluidly coupling the preflash column or retrofit preflash column to the crude unit or the vacuum unit such that the crude unit or the vacuum unit receives the pre-processed liquid feed comprises:

fluidly coupling the preflash column to the crude unit or the vacuum unit such that the crude unit or the vacuum unit receives the pre-processed liquid feed.

15. The method of claim 14, wherein the preflash column is further configured to use the reboiler to so form the pre-processed liquid feed.

16. The method of claim 14, wherein the preflash column is further configured to use the steam stripping unit to so form the pre-processed liquid feed.

17. The method of claim 14, wherein fluidly coupling the preflash column to the crude unit or the vacuum unit such that the crude unit or the vacuum unit receives the pre-processed liquid feed comprises:

fluidly coupling the preflash column to the crude unit such that the crude unit receives the pre-processed liquid feed.

18. The method of claim 14, wherein fluidly coupling the preflash column to the crude unit or the vacuum unit such that the crude unit or the vacuum unit receives the pre-processed liquid feed comprises:

fluidly coupling the preflash column to the vacuum unit such that the vacuum unit receives the pre-processed liquid feed.

19. The method of claim 14, wherein the preflash column is configured to receive the heated liquid stream and the vapor stream.

20. The method of claim 19, wherein the heated liquid stream and the vapor stream are received by the preflash column separately.

* * * * *